US006863124B2

(12) United States Patent
Araux et al.

(10) Patent No.: US 6,863,124 B2
(45) Date of Patent: Mar. 8, 2005

(54) SEALED ESP MOTOR SYSTEM

(75) Inventors: Grigory L. Araux, Missouri City, TX (US); Steven E. Buchanan, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/321,241

(22) Filed: Dec. 17, 2002

(65) Prior Publication Data

US 2003/0132003 A1 Jul. 17, 2003

Related U.S. Application Data

(60) Provisional application No. 60/342,786, filed on Dec. 21, 2001.

(51) Int. Cl.[7] ..... E21B 43/00

(52) U.S. Cl. ..... 166/66.4; 166/66.5; 166/105; 417/420; 417/423.3

(58) Field of Search ..... 166/369, 370, 166/105, 66.4, 66.5; 417/420, 423.3, 423.14

(56) References Cited

U.S. PATENT DOCUMENTS

| | | | | |
|---|---|---|---|---|
| 4,235,569 | A | | 11/1980 | Wegner et al. |
| 4,436,488 | A | | 3/1984 | Witten |
| 4,487,299 | A | * | 12/1984 | Bookout ..... 188/313 |
| 4,546,300 | A | | 10/1985 | Shaikh |
| 4,714,403 | A | | 12/1987 | Russell et al. |
| 4,725,197 | A | | 2/1988 | Russell et al. |
| 4,732,225 | A | | 3/1988 | Christensen |
| 4,780,066 | A | | 10/1988 | Bolleter et al. |
| 5,045,026 | A | * | 9/1991 | Buse ..... 464/29 |
| 5,501,582 | A | * | 3/1996 | Gautier et al. ..... 417/420 |
| 5,505,594 | A | | 4/1996 | Sheehan |
| 5,857,842 | A | | 1/1999 | Sheehan |
| 6,206,093 | B1 | | 3/2001 | Lee et al. |
| 6,213,736 | B1 | | 4/2001 | Weisser |
| 6,364,013 | B1 | | 4/2002 | Watson |
| 6,379,127 | B1 | * | 4/2002 | Andrews et al. ..... 417/423.11 |
| 6,388,353 | B1 | * | 5/2002 | Liu et al. ..... 310/156.09 |
| 6,468,058 | B1 | * | 10/2002 | Breit et al. ..... 417/423.3 |
| 2001/0033800 | A1 | | 10/2001 | Deai et al. |

FOREIGN PATENT DOCUMENTS

| | | | |
|---|---|---|---|
| DE | 4214848 | A | 11/1993 |
| EP | 1303025 | A2 | 4/2003 |
| FR | 2480360 | A | 10/1981 |
| FR | 2509804 | A | 1/1983 |
| GB | 2085667 | A | 4/1982 |
| GB | 2379562 | A | 3/2003 |
| JP | 60098195 | A | 6/1985 |
| JP | 11093883 | A | 4/1999 |

* cited by examiner

*Primary Examiner*—Hoang Dang
(74) *Attorney, Agent, or Firm*—Van Someren, P.C.; Jaime A. Castano; Brigitte Echols

(57) ABSTRACT

The present invention provides a submersible motor and pump system for use in a wellbore. More specifically, the present invention provides a submersible system having a sealed motor and a magnetic coupling to transmit torque from the sealed motor to the pump.

19 Claims, 10 Drawing Sheets

SEALED ESP MOTOR SYSTEM

This application claims the benefit of U.S. Provisional Application No. 60/342,786 filed Dec. 21, 2001.

FIELD OF THE INVENTION

The present invention relates generally to pumping systems utilized in raising fluids from wells, and particularly to a submersible pumping system having a sealed motor.

BACKGROUND OF THE INVENTION

In producing petroleum and other useful fluids from production wells, it is generally known to provide a submersible pumping system, such as an electric submersible pumping system (ESP), for raising the fluids collected in a well. Typically, production fluids enter a wellbore via perforations made in a well casing adjacent a production formation. Fluids contained in the formation collect in the wellbore and may be raised by the pumping system to a collection point above the earth's surface. The ESP systems can also be used to move the fluid from one zone to another.

An ESP system is generally comprised of a motor section, a pump section, and a protector. Current motor designs require clean oil, not only to minimize magnetic losses, but also to provide appropriate lubrication in the hydrodynamic bearings that support the rotor. Contamination of the clean oil leads to short circuit which is one of the most common failure modes in electric motors used in ESP applications.

The protector of a typical ESP system provides an elaborate seal intended to maintain the clean oil environment separate from the well fluid. One end of the protector is open to the well bore, while the other end is connected to the interior of the motor. Existing protectors have the common purpose of forming a barrier between the motor oil and the well fluid. Circumstances such as thermal cycling, mechanical seal failures, wear, or scale can result in a malfunction of the protector. Such malfunction allows well fluid to reach the motor resulting in an electrical short circuit.

DETAILED DESCRIPTION OF PREFERRED EMBODIMENTS

Figure 1:
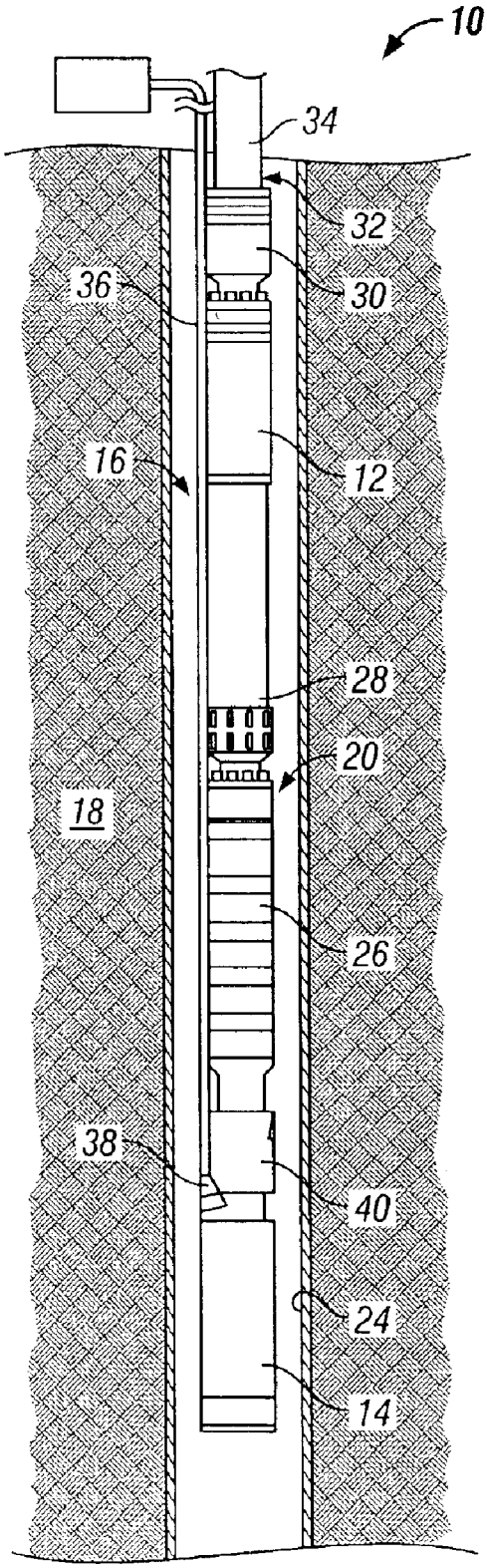
FIG. 1 is a front elevational view of a submersible pumping system positioned in a wellbore and having an embodiment of the sealed motor system of the present invention FIG. 2 provides a side view of an embodiment of the magnetic coupling of the sealed motor system.

Referring generally to FIG. 1, a submersible pumping system, such as an electric submersible pumping system (ESP), having an embodiment of the sealed motor system 10 of the present invention is illustrated. The submersible pumping system may comprise a variety of components depending on the particular application or environment in which it is used. The sealed motor system 10 used therein includes at least a submersible pump 12 and a submersible sealed motor 14.

The submersible pumping system is designed for deployment in a well 16 within a geological formation 18 containing desirable production fluids, such as petroleum. In a typical application, a wellbore 20 is drilled and lined with a wellbore casing 24. The submersible system is deployed within wellbore 20 to a desired location for pumping of wellbore fluids.

The sealed motor system 10 includes a variety of additional components. A protector 26 serves to transmit torque generated by the motor 16 to the submersible pump 12. The protector 26 additionally includes thrust bearings designed to carry the thrust loads generated within the submersible pump 12. The system 10 further includes a pump intake 28 through which wellbore fluids are drawn into the submersible pump 12.

The submersible pumping system also includes a connector or discharge head 30 by which the submersible pumping system is connected to a deployment system 32. The deployment system 32 may comprise a cable, coil tubing, or production tubing. In the illustrated embodiment, the deployment system 32 comprises production tubing 34 through which the wellbore fluids are pumped to another zone or to the surface of the earth. A power cable 36 is disposed along the deployment system 32 and routed to a bulkhead 38 within the housing of the sealed motor 14 to provide power thereto. In one embodiment, the bulkhead 38 is a glass sealed bulkhead.

In an embodiment of the sealed motor system 10 of the present invention, a magnetic coupling 40 is affixed between the sealed motor 14 and the protector 26. The magnetic coupling 40 enables torque generated by the sealed motor 14 to be transmitted to the protector 26 and the pump 12 while maintaining the motor 14 in a separate, sealed housing. In other words, the magnetic coupling 40 removes the necessity of mechanical interaction between the motor shaft and the shaft of the protector 26 or the pump 12. The torque generated by the sealed motor 14 is transmitted to the protector 26 and the pump 12 by magnetic fields acting through the sealed motor casing.

Figure 2:
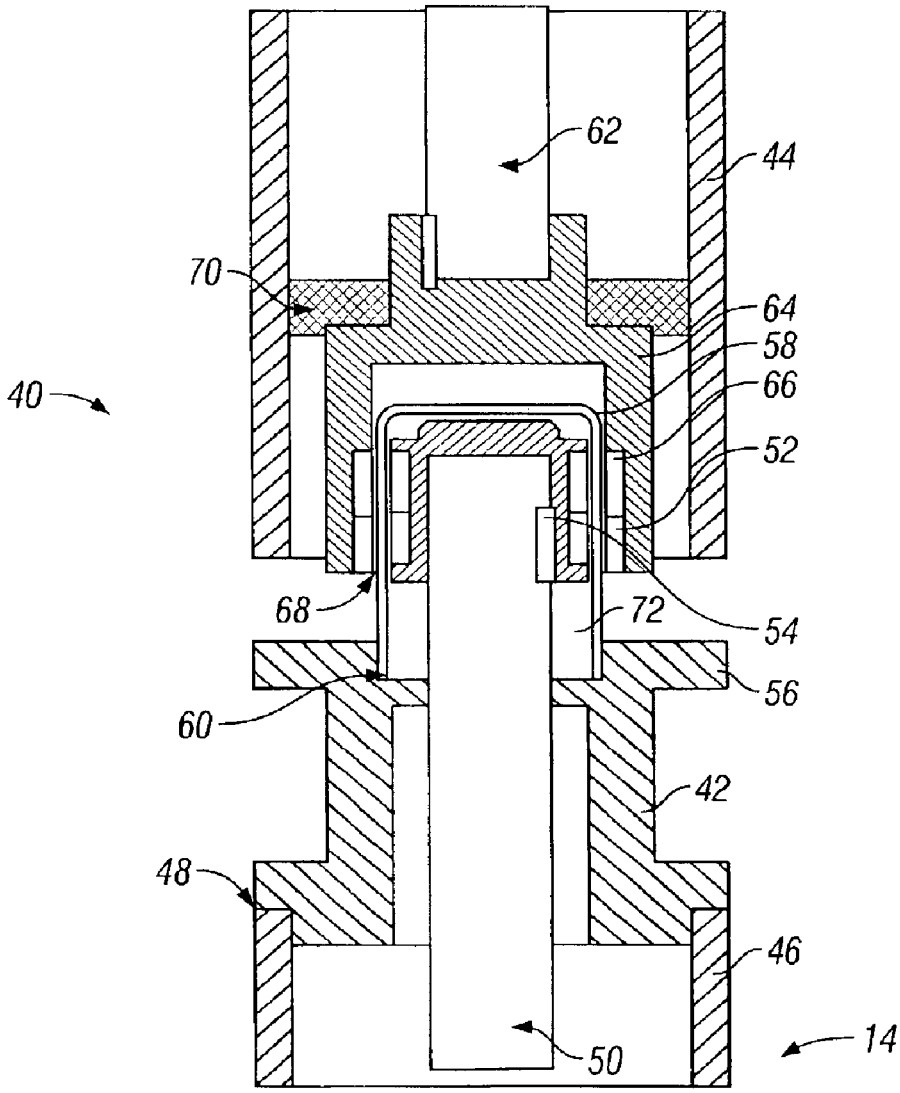
Figure 3:
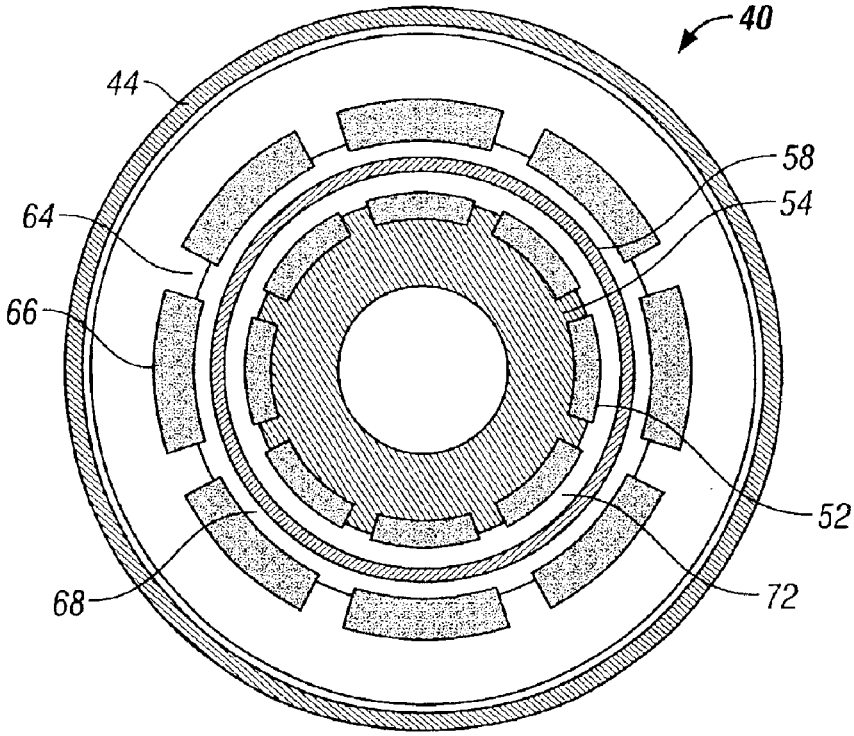
FIG. 3 provides an end view of an embodiment of the magnetic coupling of the sealed motor system.

FIGS. 2 and 3 provide side and end views, respectively, of an embodiment of the magnetic coupling 40 of the sealed motor system 10. The magnetic coupling 40 is generally comprised of a motor-side housing 42 and a pump-side housing 44. The motor-side housing 42 is affixed to the motor housing 46 of the motor 14 such that the motor 14 remains sealed from the surrounding wellbore fluids. In one exemplary embodiment, the motor-side housing 42 is affixed to the motor housing 46 by welds 48.

The motor-side housing 42 has a motor-side shaft 50 running therethrough. The motor-side shaft 50 is rotatably driven by the sealed motor 14. In a typical embodiment, the motor-side shaft 50 is affixed to the motor shaft (not shown). Permanent magnets 52, arranged in rings, are mounted to the motor-side shaft 50 by a motor-side rotor 54. The permanent magnets 52 rotate along with the motor-side shaft 50.

Affixed to the top end 56 of the motor-side housing 42 is a thin-walled shell 58. The shell 58 covers the motor-side shaft 50 as well as the permanent magnets 52, arranged in rings, affixed thereto. The thin-walled shell 58 is affixed to the motor-side housing 42 such that the motor 14 remains sealed. In one exemplary embodiment, the thin-walled shell 58 is affixed to the motor-side housing 42 by welds 60.

In one embodiment, the thin-walled shell 58 is made of a high strength non-magnetic material such as Hastelloy or titanium. In other embodiments, to avoid high eddy current losses, the thin-walled shell 58 can be made of a non-conducting high performance composite material such as carbon-reinforced PEEK.

The pump-side housing 44 has a pump-side shaft 62 running therethrough. In a typical embodiment, the pump-side shaft 62 is affixed to the pump shaft (not shown). Affixed to the base of the pump-side shaft 62 is a pump-side rotor 64 that has permanent magnets 66 mounted thereto. Rotation of the pump-side rotor 64 results in rotation of the pump-side shaft 62 and consequentially the pump shaft.

Figure 4:
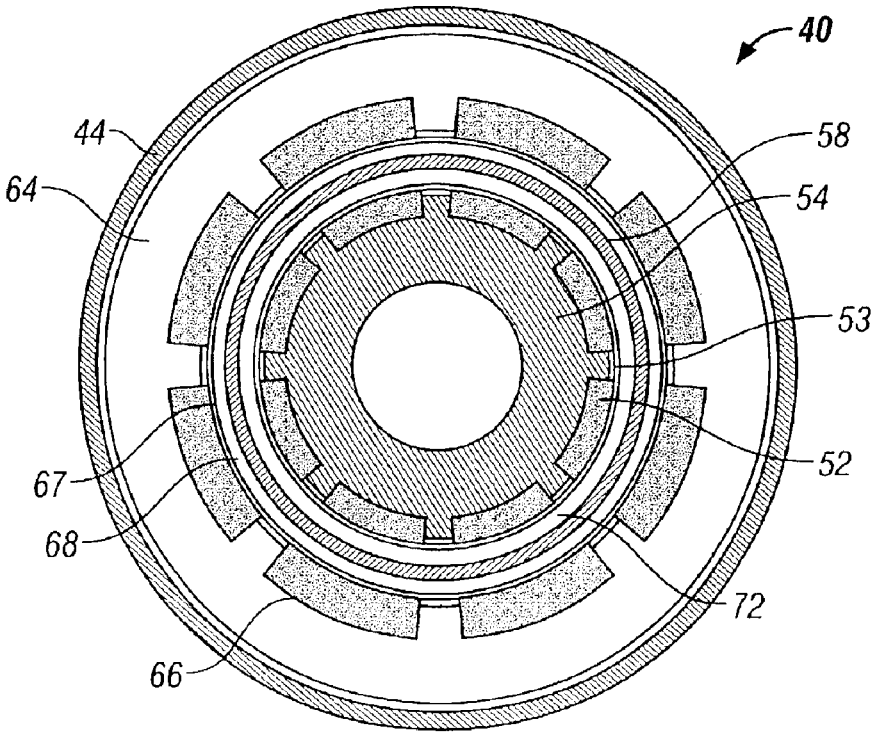
FIG. 4 provides an end view of an embodiment of the magnetic coupling of the sealed motor system in which the permanent magnets are enclosed by a thin metal sleeve.
Figure 5A:
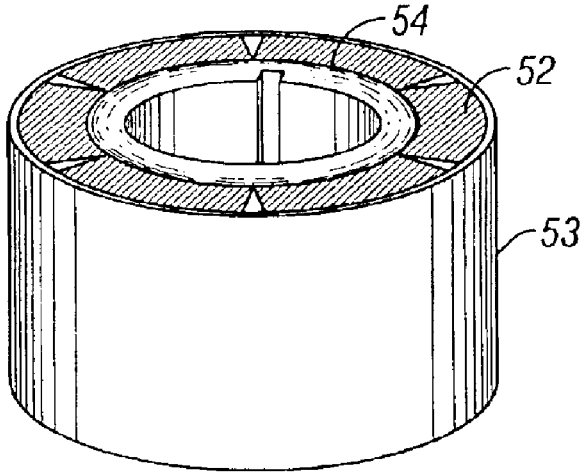
FIG. 5 provides a perspective view of an embodiment of the motor-side rotor and the pump-side rotor of the magnetic coupling in which the permanent magnets are enclosed by a thin metal sleeve.
Figure 5B:
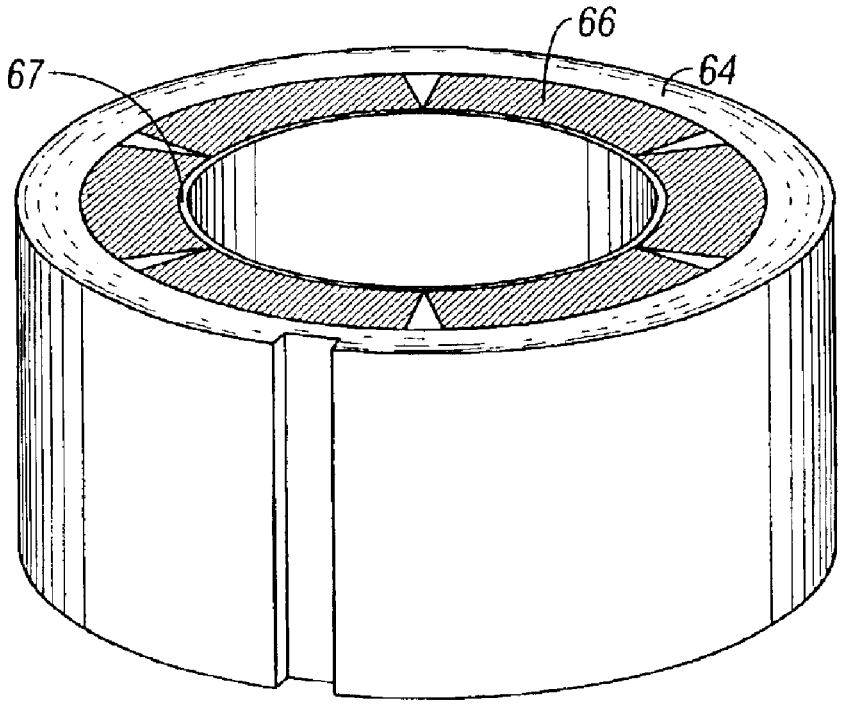

In one embodiment, the permanent magnets 52, 66 are made from materials with a high density of magnetic energy such as neodymium iron-boron or samarium cobalt. The permanent magnets 52, 66 are closely aligned and the distance from the magnets 52, 66 to the shell 58 is small to reduce magnetic losses. FIGS. 4 and 5 illustrate an embodiment of the magnetic coupling 40 of the sealed motor system 10 in which the magnets 52, 66 can be enclosed by thin metal sleeves 53, 67 to provide mechanical protection and corrosion resistance. FIG. 4 provides a side view and FIG. 5 provides a perspective view of the motor-side rotor 54 and the pump-side rotor 64 having the thin metal sleeves 53, 67. The sleeves 53, 67 can be made of a thin non-magnetic material and will produce no Eddy current losses since there is no relative motion with respect to the magnets 52, 56.

Referring back to FIG. 2, the permanent magnets 52 within the motor-side housing 42 along with the permanent magnets 66 in the pump-side housing 44 act to create a magnetic field that enables the synchronous transmission of the rotating motion from the motor-side shaft 50 to the pump-side shaft 62.

As the motor-side shaft 50 is rotated by operation of the sealed motor 14, the motor-side rotor 54 rotates along with the affixed permanent magnets 52. Because the permanent magnets 52 of the motor-side rotor 54 are magnetically linked to the permanent magnets 66 of the pump-side rotor 64, the pump-side rotor 64 is forced to rotate resulting in rotation of the pump-side shaft 62 and the affixed pump shaft. The magnetic field runs through the thin-walled shell 58, eliminating any need for mechanical connection between the motor-side shaft 50 and the pump-side shaft 62, enabling the motor 14 to remain completely sealed.

Because the magnetic coupling 40 is a non-contact coupling, the dynamics of the motor-side components and the pump-side components are isolated. In other words, dynamic or vibration problems existing in the sealed motor 14 are not transmitted to the pump 12, and vice versa.

Although the magnetic coupling 40 does not require any specific fluid to operate, the presence of solids in the small gap 68 that exists between the thin-walled shell 58 and the pump-side rotor 64 can create additional friction compromising the power capability of the magnetic coupling 40. Because the components of the magnetic coupling 40 that are located within the pump-side housing 44 are likely to be exposed to well fluid, a metallic knitted mesh 70, or other screen, is provided as a means to stop solids from reaching the small gap 68 in the coupling.

It is understood that the above concern does not exist within the motor-side housing 42. The motor-side housing 42 is filled with clean oil 72 and is sealed from exposure to the surrounding well fluids to avoid contamination. However, good circulation of the oil 72 may be required to remove heat from the coupling.

Figure 6:
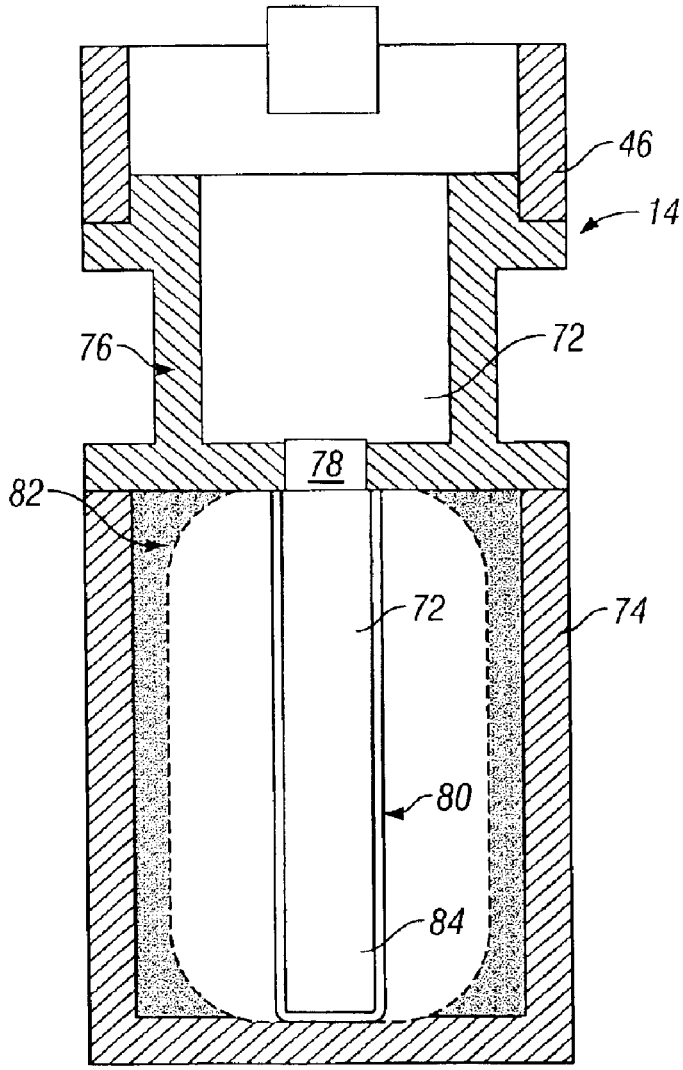
FIG. 6 provides an illustration of an embodiment of the sealed motor allowing for the thermal expansion of the motor oil.

FIG. 6 provides an illustration of an embodiment of the sealed motor 14 of the sealed motor system 10 allowing for the thermal expansion of the motor oil 72. As illustrated, such expansion is accommodated by the inclusion of a pressurized expansion chamber 74 affixed to the base 76 of the sealed motor 14. A fluid channel 78 extends therethrough the base 76 to enable communication between the sealed motor 14 and the expansion chamber 74.

Located within the expansion chamber 74, is a flexible element 80, such as an elastomeric bag, that is attached to the base 76 of the sealed motor 14. The flexible element 80 is surrounded by pressurized gas 82 while its interior 84 is in communication with the motor oil 72 through the fluid channel 78. In cold conditions, the pressure of the gas 82 keeps the flexible element 80 in its compressed state. When the temperature rises, the thermal expansion of the oil 72 overcomes the pressure of the gas 82 and the flexible element 80 expands.

Figure 7:
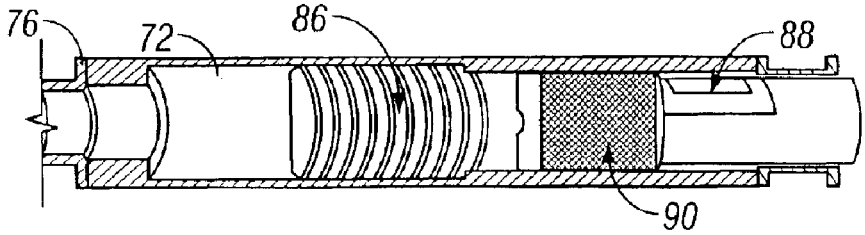
FIG. 7 provides an illustration of another embodiment of the sealed motor allowing for the thermal expansion of the motor oil.

Another embodiment of the sealed motor 14 of the sealed motor system 10 allowing for thermal expansion of the motor oil 72 is illustrated in FIG. 7. In this embodiment, the thermal expansion is accommodated by the inclusion of a metal bellows 86 housed within the pressurized expansion chamber 74 that is affixed to the base 76 of the sealed motor 14.

On the motor-side of the bellows 86, the bellows 86 is exposed to the motor oil 72. On the other side of the bellows 86, the bellows 86 is exposed to wellbore fluid via the wellbore fluid inlet 88. A metal mesh screen 90 is provided proximate the fluid inlet 88 to keep large debris from interfering with the flexures of the bellows 86.

The bellows 86 expands and compresses in response to the fluid pressure of the oil 72 and the well fluid so as to effectively equalize the pressure. As such, the bellows 86 minimizes the net fluid pressure forces acting on the components of the sealed motor 14.

Figure 8:
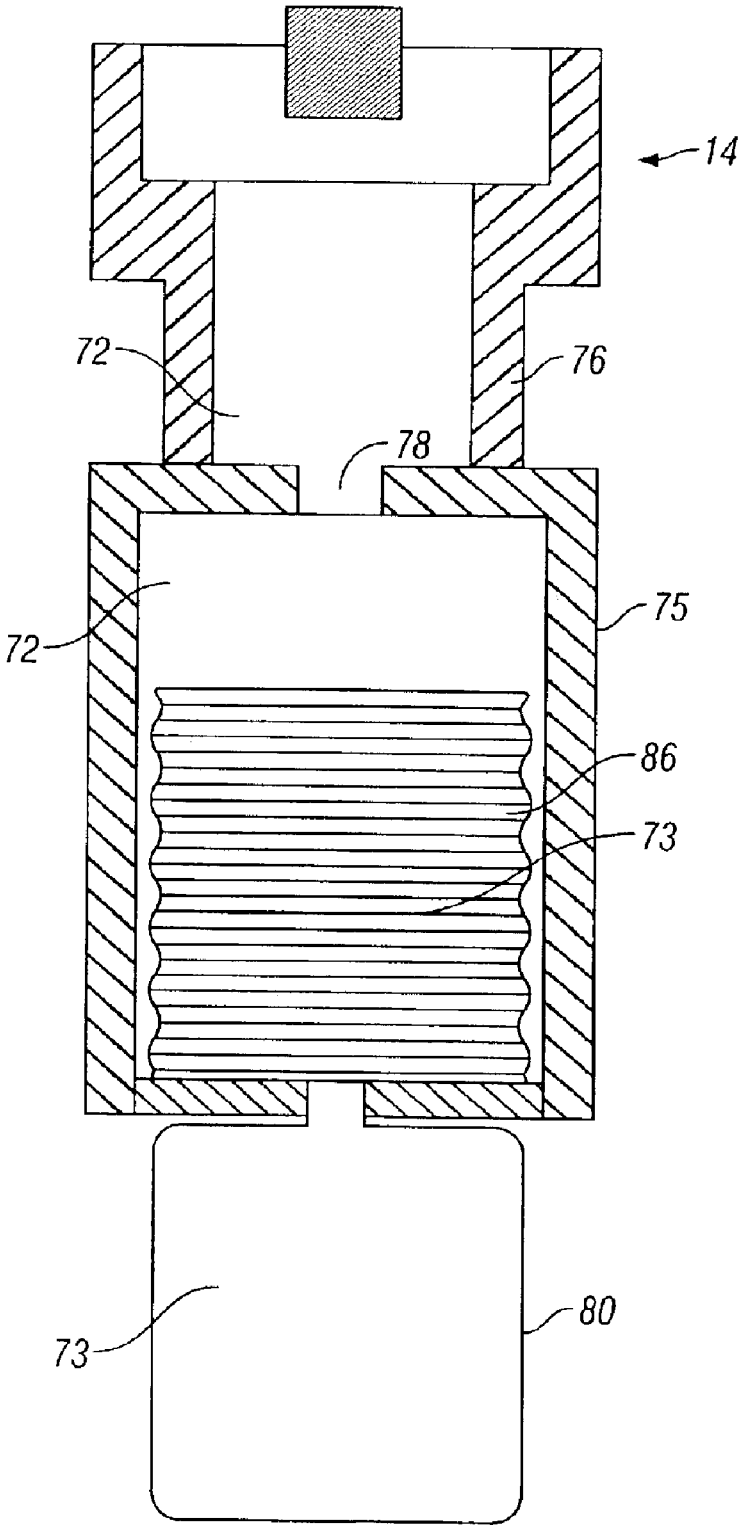
FIG. 8 provides an illustration of another embodiment of the sealed motor allowing for the thermal expansion of the motor oil.

Another embodiment of the sealed motor 14 of the sealed motor system 10 using a bellows 86 to allowing for thermal expansion of the motor oil 72 is illustrated schematically in FIG. 8. In this embodiment, an expansion chamber 75 is affixed to the base 76 of the sealed motor 14. A fluid channel 78 extends therethrough the base 76 to enable communication between the sealed motor 14 and the expansion chamber 75.

Located within the expansion chamber 75 is the bellows 86. The expansion chamber 75 protects the bellows 86 from the surrounding wellbore fluid such that the exterior of the bellows 86 is only in contact with the motor oil 72 contained within the sealed motor 14. The interior of the bellows 86 is filled with clean oil 73.

A flexible element 80 is affixed to the base of the bellows 86 such that the interior of the flexible element 80 is in communication with the clean oil 73 contained within the interior of the bellows 86. The exterior of the flexible element 80 is in communication with the surrounding wellbore fluid.

The bellows 86 expands and compresses in response to the fluid pressure of the oil 72, 73 and the fluid pressure of the surrounding wellbore fluid acting on the exterior of the flexible element 80. In this manner, the bellows 86 acts to effectively equalize the pressure. As such, the bellows 86 minimizes the net fluid pressure forces acting on the components of the sealed motor 14.

Figure 9:
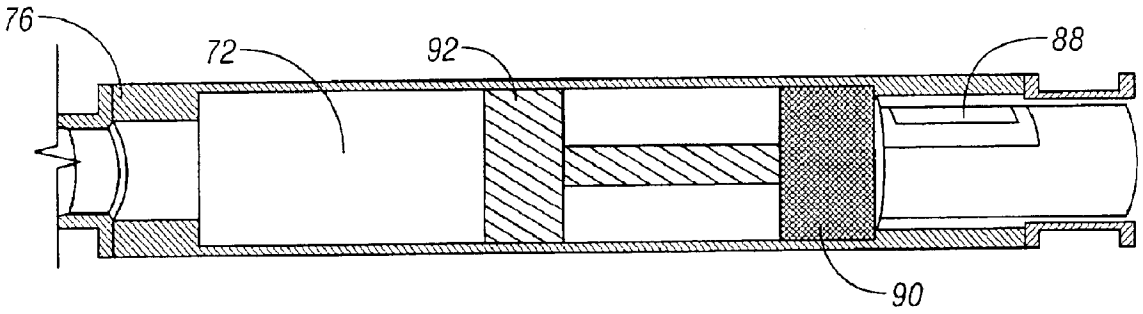
FIG. 9 provides an illustration of yet another embodiment of the sealed motor allowing for the thermal expansion of the motor oil.

Yet another embodiment of the sealed motor 14 of the sealed motor system 10 allowing for thermal expansion of the motor oil 72 is illustrated in FIG. 9. In this embodiment, the thermal expansion is accommodated by the inclusion of a piston 92 housed within the pressurized expansion chamber 74 that is affixed to the base 76 of the sealed motor 14.

On the motor-side of the piston 92, the piston 92 is exposed to the motor oil 72. On the other side of the piston 92, the piston 92 is exposed to wellbore fluid via the wellbore fluid inlet 88. A metal mesh screen 90 is provided proximate the fluid inlet 88 to keep large debris from interfering with the action of the piston 92.

The piston 92 is configured to move in response to the fluid pressure of the oil 72 and the well fluid so as to effectively equalize the pressure. As such, the piston 92 minimizes the net fluid pressure forces acting on the components of the sealed motor 14.

In alternate embodiments, the sealed motor 14 can be filled with gas instead of motor oil 72. This removes the necessity of the expansion chamber 74. Using gas instead of motor oil 72 requires the use of gas or foil bearings.

Figure 10:
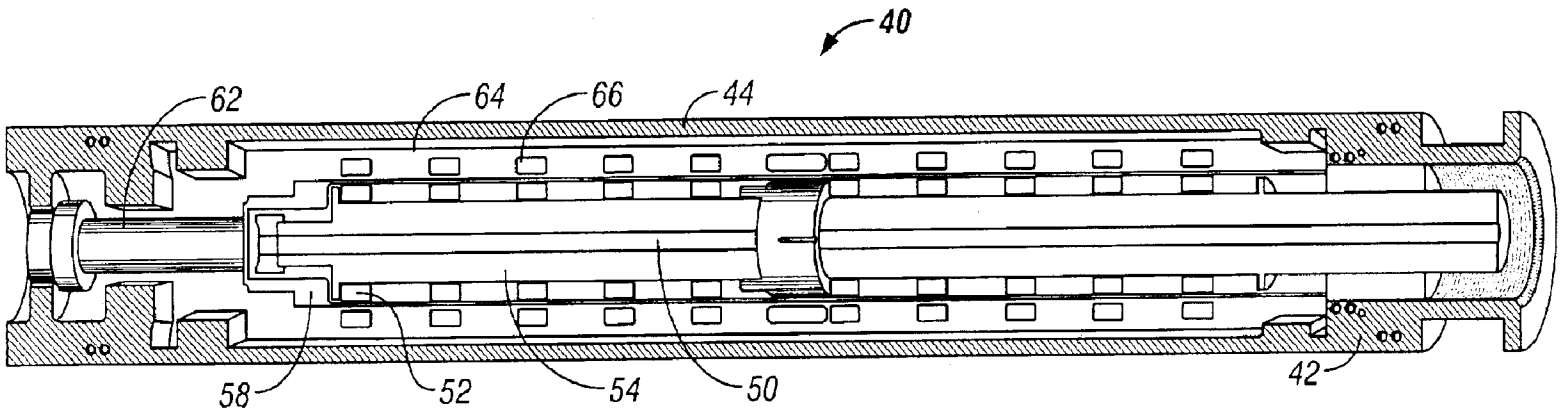
FIG. 10 illustrates an embodiment of the magnetic coupling of the sealed motor system having a plurality of magnets mounted along the motor-side shaft.

Because the diameter of the magnetic coupling 40 employed by the sealed motor system 10 is constrained by the size of the well, to increase the power transmitted by the sealed motor system 10, the length of the magnetic coupling 40 must be increased. FIG. 10 illustrates one such extended length embodiment is which the magnetic coupling 40 of the sealed motor system 10 has a plurality of magnets 52, 66 mounted along the motor-side shaft 50.

The magnetic coupling 40 in this embodiment is again comprised of a motor-side housing 42 and a pump-side housing 44. The motor-side housing 42 is affixed to the sealed motor 14 by means, such as welding, that ensure the motor 14 remains sealed from the surrounding wellbore fluids.

The motor-side shaft 42 runs therethrough the motor-side housing 42 and is rotatably driven by the sealed motor 14. A plurality of permanent magnets 52, arranged in rings, are mounted to the motor-side shaft 50 by a motor-side rotor 54.

Affixed to the top end 56 of the motor-side housing 42 is the thin-walled shell 58. The shell 58 covers the motor-side shaft 50 as well as the plurality of permanent magnets 52, arranged in rings, affixed thereto. The thin-walled shell 58 is affixed to the motor-side housing 42 such that the motor 14 remains sealed. In one exemplary embodiment, the thin-walled shell 58 is affixed by welds 60.

As discussed above, the thin-walled shell 58 can be made of a high strength non-magnetic material such as Hastelloy or titanium. Likewise, the thin-walled shell 58 can be made of a non-conducting high performance composite material such as carbon-reinforced PEEK.

The pump-side shaft 62 runs through the pump-side housing 44. Affixed to the base of the pump-side shaft 62 is the pump-side rotor 64 that has a plurality of permanent magnets 66, arranged in rings, mounted thereto. The plurality of permanent magnets 66 mounted to the pump-side rotor 64 are located at the same axial location as the plurality of permanent magnets 52 mounted to the motor-side rotor 54.

The plurality of permanent magnets 52 within the motor-side housing 14 along with the plurality of permanent magnets 66 in the pump-side housing 44 act to create a magnetic field that enables the synchronous transmission of the rotating motion from the motor-side shaft 50 to the pump-side shaft 62.

As the motor-side shaft 50 is rotated by operation of the sealed motor 14, the motor-side rotor 54 rotates along with the affixed plurality of permanent magnets 52. Because the plurality of permanent magnets 52 of the motor-side rotor 54 are magnetically linked to the plurality of permanent magnets 66 of the pump-side rotor 64, the pump-side rotor 64 is forced to rotate resulting in rotation of the pump-side shaft 62 and the affixed pump shaft. The magnetic field runs through the thin-walled shell 58, eliminating any need for mechanical connection between the motor-side shaft 50 and the pump-side shaft 62, enabling the motor 14 to remain completely sealed.

The magnetic coupling 40 of the sealed motor system 10 is typically supported at either end by hydrodynamic bearings, such as plain journal bearings. Where space permits, bearings such as tilt-pad, lemon bore, and offset bearings can be used to advantage at either end of the magnetic coupling 40.

As the length of the coupling 40 increases to accommodate higher power requirements of the sealed motor system 10, it may be necessary to provide one or more intermediate bearing supports 94 to enhance the dynamic stability of the coupling 40. In one embodiment, where space permits, bearings such as tilt-pad, lemon bore, and offset bearings can be used to advantage as the intermediate bearing supports 94.

Figure 11:
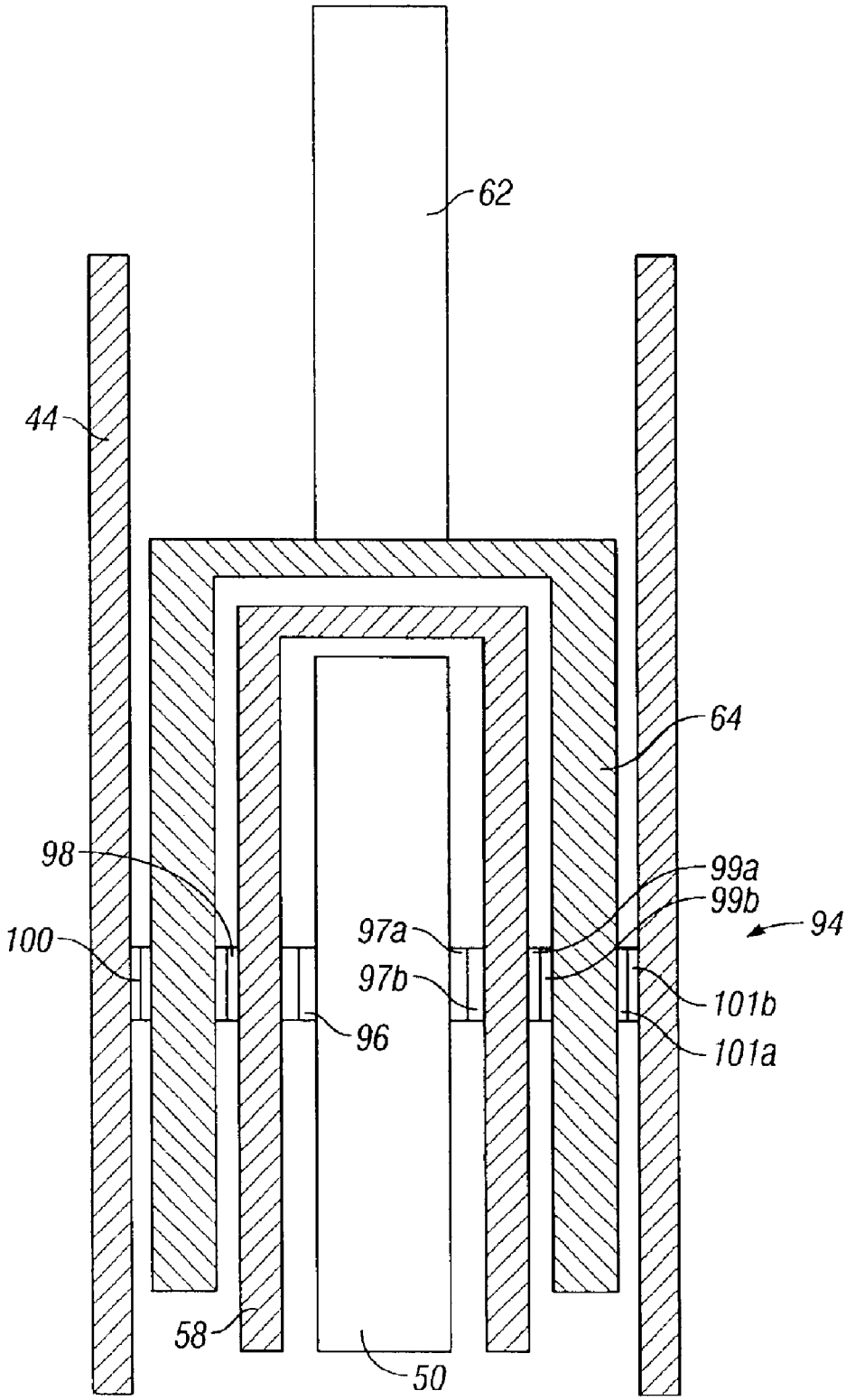
FIG. 11 provides a schematic of one embodiment of an intermediate bearing support of the magnetic coupling of the sealed motor system.

In additional embodiments, intermediate bearings supports 94 such as that illustrated in FIG. 11 can be used to enhance the dynamic stability of the magnetic coupling 40. In this embodiment, the intermediate bearing supports 94 are comprised generally of three intermediate bearings 96, 98, 100.

The first intermediate bearing 96 is located between the rotatable motor-side shaft 50 and the stationary thin-walled shell 58. The stationary sleeve **97*b* of the first intermediate bearing 96 is affixed to the thin-walled shell 58 while the rotatable interior surface 97*a* is located proximate the motor-side shaft 50**.

The second intermediate bearing 98 is located between the stationary thin-walled shell 58 and the rotatable pump-side rotor 64 that is connected to the pump-side shaft 62. The second intermediate bearing 98 is concentric with the first intermediate bearing 96 and located at the same axial location. The stationary sleeve 99*a* of the second intermediate bearing 98 is affixed to the thin-walled shell 58 while its rotatable exterior surface 99*b* is located proximate the pump-side rotor 64.

Figure 12:
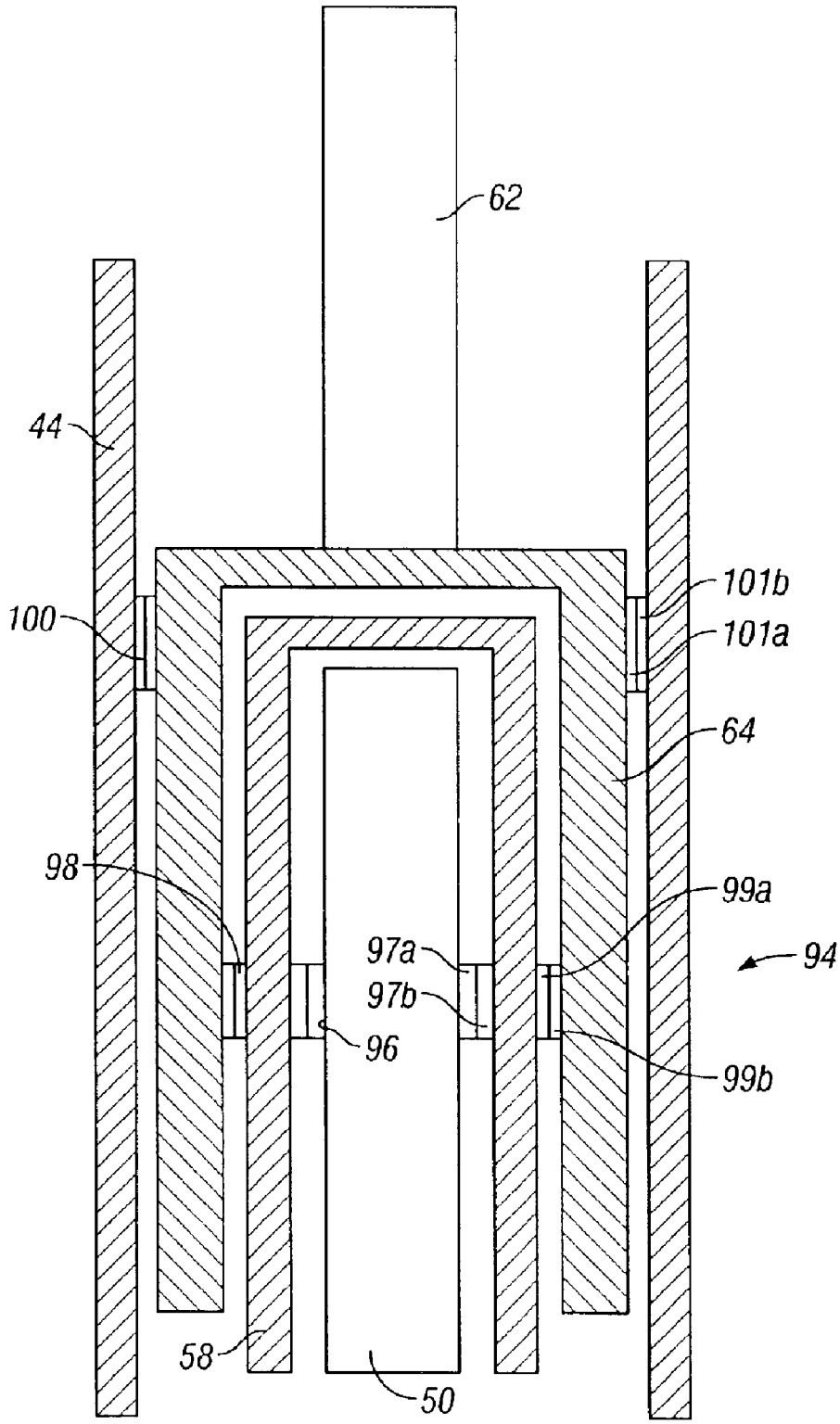
FIG. 12 provides a schematic of another embodiment of an intermediate bearing support of the magnetic coupling of the sealed motor system.

The third intermediate bearing 100 is located between the rotatable pump-side rotor 64 and the stationary pump-side housing 44. The third intermediate bearing 100 is comprised of a stationary sleeve 101*b* affixed to the pump-side housing 44 and a rotating interior surface 101*a* proximate the pump-side rotor 64. In the embodiment shown in FIG. 11, the third intermediate bearing 100 is located at the same axial location as the first and second intermediate bearings 96, 98. However, it should be understood that the third intermediate bearing 100 can be located anywhere along the length of the pump-side rotor 64. One such example is shown in FIG. 12.

Figure 13:
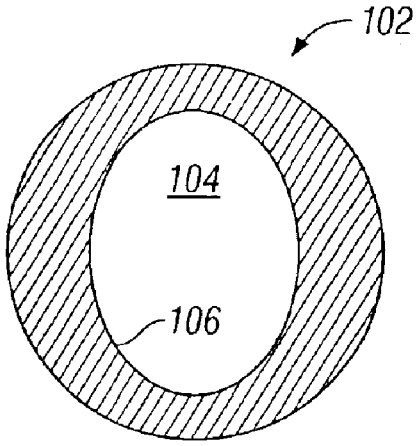
FIG. 13 provides a schematic of another embodiment of an intermediate bearing support of the magnetic coupling of the sealed motor system.

Another embodiment of an intermediate bearing support 94 is described with reference to FIG. 13. In this embodiment, enhanced stability of the magnetic coupling 40 is achieved by creating an elliptical surface in the thin-walled shell 58. The elliptical shape in the shell 58 can be achieved by using a bearing 102 having an elliptical hole 104 bored into the bearing portion 106 that contacts the shell 58. The elliptical shape of the shell 58 has stabilizing effects similar to hydrodynamic bearings that enhance stability (e.g., tilt-pad, lemon bore, offset bearings).

Figure 14:
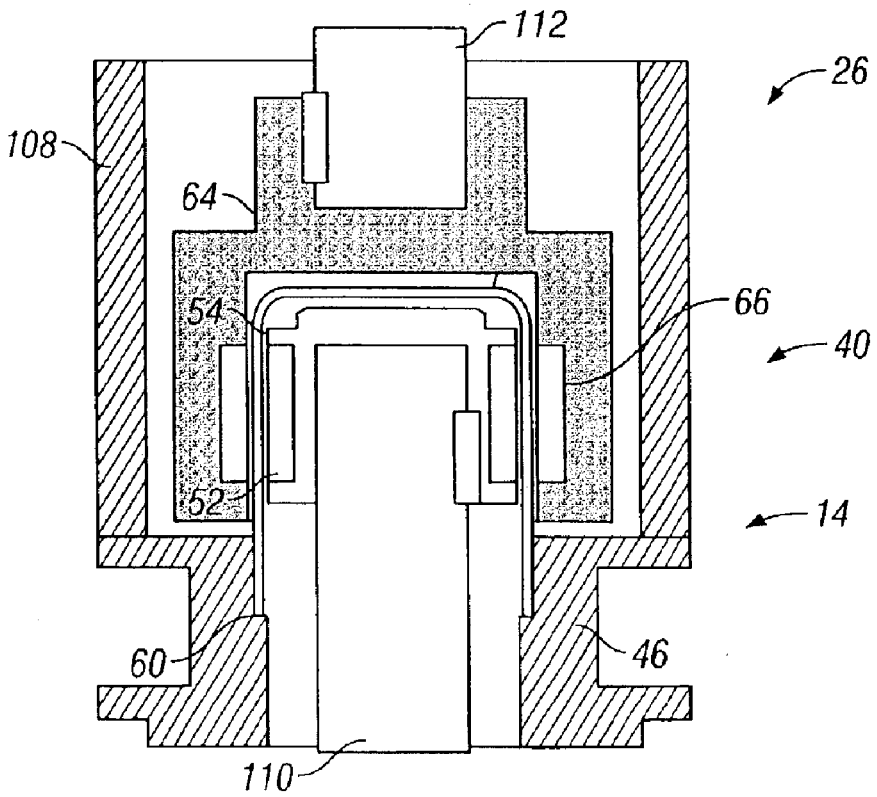
FIG. 14 provides an illustration of an embodiment of the sealed motor system where the magnetic coupling is integral with the sealed motor and the protector.

FIG. 14 provides a schematic illustration of an embodiment of the sealed motor system 10 where the magnetic coupling 40 is integral with the sealed motor 14 and the protector 26. The internal components of the magnetic coupling 40 remain as described above, but are not housed within a separate coupling housing. Rather, the internal components in this embodiment are housed within the lower portion of the protector housing 108 and the upper portion of the motor housing 46. As such, the motor housing 46 can be affixed directly to the protector housing 108.

One advantage of this embodiment is that the torque is supplied through the components of the magnetic coupling 40 directly from the motor shaft 110 to the shaft of the protector 112.

In additional embodiments of the sealed motor system 10, the protector 26 can be eliminated altogether by carrying the thrust load in either the sealed motor 14 or the pump 12. In such case, the sealed motor 14 can be affixed directly to the pump 12.

The invention being thus described, it will be obvious that the same may be varied in many ways. Such variations are not to be regarded as a departure from the spirit and scope of the invention, and all such are intended to be included within the scope of the following non-limiting claims.

What is claimed is:

1. A submersible pumping system for deployment in a well, comprising:

a submersible pump;

a motor located within a housing sealed from contamination with well fluids; and a magnetic coupling adapted to magnetically drive the submersible pump via the motor, wherein the dynamic stability of the magnetic coupling is enhanced by an intermediate bearing support having three intermediate bearings concentric with each other at the same axial position.

2. The submersible pumping system of claim 1, further comprising a magnetic coupling adapted to transmit torque from the motor to the submersible pump.

3. The submersible pumping system of claim 2 further comprising a protector adapted to transmit torque from the magnetic coupling to the submersible pump.

4. The submersible pumping system of claim 1 further comprising a protector adapted to transmit torque to the submersible pump.

5. The submersible pumping system of claim 1 further comprising thrust bearings.

6. A system to transmit torque from motor to a pump for pumping well fluids, comprising:

a motor-side housing affixed to the motor;

a motor-side shaft rotatably driven by the motor;

a motor-side rotor affixed to the motor-side shaft and having at least one permanent magnet affixed thereto;

a protective shell affixed to the motor-side housing and adapted to seal the motor, motor-side shaft and the motor-side rotor from the surrounding well fluids;

a pump-side housing affixed to the pump;

a pump-side shaft adapted to drive the pump;

a pump-side rotor affixed to the pump-side shaft and having at least one permanent magnet affixed thereto; and wherein the at least one permanent magnet affixed to the motor-side rotor interacts with the at least one permanent magnet affixed to the pump-side rotor to create a magnetic field that transmits through the protective shell to enable synchronous transmission of torque from the motor-side shaft to the pump-side shaft; and an intermediate bearing support having three intermediate bearings concentric with each other at the same axial position.

7. The system of claim 6, wherein the motor-side housing is welded to the motor.

8. The system of claim 6, wherein the at least one permanent magnet of the motor-side rotor is arranged in rings.

9. The system of claim 6, wherein the protective shell is made of a high strength, non-magnetic material.

10. The system of claim 6, wherein the protective shell is made of a non-conducting composite material.

11. The system of claim 10, wherein the composite material is carbon-reinforced PEEK.

12. The system of claim 6, wherein the at least one permanent magnet affixed to the motor-side rotor is enclosed by a non-magnetic sleeve.

13. The system of claim 6, wherein the at least one permanent magnet affixed to the pump-side rotor is enclosed by a non-magnetic sleeve.

14. The system of claim 6, wherein the sealed motor is filled with clean oil.

15. The system of claim 6, further comprising a pressure and volume compensating device affixed to the sealed motor.

16. A magnetic coupling for use in a submersible pumping system, comprising:

a motor sealed from well fluids by a protective housing;

a motor shaft within the protective housing having a plurality of magnets affixed thereto;

a pump having a pump housing;

a pump rotor located outside the protective housing and having a plurality of magnets affixed thereto magnetically linked to the magnets affixed to the motor shaft, wherein rotation of the motor shaft causes the pump rotor to rotate; and one or more intermediate bearing supports, wherein the one or more intermediate bearing supports comprise tilt-pad bearings.

17. A magnetic coupling for use in a submersible pumping system, comprising:

a motor sealed from well fluids by a protective housing;

a motor shaft within the protective housing having a plurality of magnets affixed thereto;

a pump having a pump housing;

a pump rotor located outside the protective housing and having a plurality of magnets affixed thereto magnetically linked to the magnets affixed to the motor shaft, wherein rotation of the motor shaft causes the pump rotor to rotate; and one or more intermediate bearing supports, wherein the one or more intermediate bearing supports comprise lemon bore bearings.

18. A magnetic coupling for use in a submersible pumping system, comprising:

a motor sealed from well fluids by a protective housing;

a motor shaft within the protective housing having a plurality of magnets affixed thereto;

a pump having a pump housing;

a pump rotor located outside the protective housing and having a plurality of magnets affixed thereto magnetically linked to the magnets affixed to the motor shaft, wherein rotation of the motor shaft causes the pump rotor to rotate; and one or more intermediate bearing supports, wherein the one or more intermediate bearing supports comprise offset bearings.

19. A magnetic coupling for use in a submersible pumping system, comprising:

a motor sealed from well fluids by a protective housing;

a motor shaft within the protective housing having a plurality of magnets affixed thereto;

a pump having a pump housing;

a pump rotor located outside the protective housing and having a plurality of magnets affixed thereto magnetically linked to the magnets affixed to the motor shaft, wherein rotation of the motor shaft causes the pump rotor to rotate; and one or more intermediate bearing supports, wherein the one or more intermediate bearing supports comprise elliptical bearings adapted to shape the protective housing elliptically.

* * * * *